US010549965B1

(12) United States Patent
Cui

(10) Patent No.: US 10,549,965 B1
(45) Date of Patent: Feb. 4, 2020

(54) DOUBLE-SPEED ELECTRIC WINCH AND OPERATING METHOD THEREOF

(71) Applicant: Ningbo Lianda Winch Co., Ltd., Ningbo (CN)

(72) Inventor: Xiaojun Cui, Ningbo (CN)

( * ) Notice: Subject to any disclaimer, the term of this patent is extended or adjusted under 35 U.S.C. 154(b) by 0 days.

(21) Appl. No.: 16/116,900

(22) Filed: Aug. 29, 2018

(51) Int. Cl.

| | |
|---|---|
| ***B66D 1/24*** | (2006.01) |
| ***B66D 1/12*** | (2006.01) |
| ***B66B 11/08*** | (2006.01) |
| ***B66D 1/22*** | (2006.01) |

(52) U.S. Cl.
CPC ..... *B66D 1/24* (2013.01); *B66B 11/08* (2013.01); *B66D 1/12* (2013.01); *B66D 1/22* (2013.01); *B66D 2700/0141* (2013.01)

(58) Field of Classification Search
CPC ... B66D 1/12; B66D 1/14; B66D 1/24; B66D 1/22; B66D 2700/0141; B66B 11/08
See application file for complete search history.

(56) References Cited

U.S. PATENT DOCUMENTS

| | | | | |
|---|---|---|---|---|
| 9,908,752 | B2 * | 3/2018 | Huang | B66D 1/12 |
| 10,280,050 | B2 * | 5/2019 | Cui | B66D 1/225 |
| 10,377,608 | B2 * | 8/2019 | Cui | |
| 2010/0065799 | A1 * | 3/2010 | Zhou | B66D 1/22 254/344 |
| 2010/0127228 | A1 * | 5/2010 | Xie | B66D 1/14 254/346 |
| 2011/0065546 | A1 * | 3/2011 | Xie | B66D 1/24 475/296 |
| 2016/0068376 | A1 * | 3/2016 | Fretz | B66D 3/00 254/219 |
| 2017/0320709 | A1 * | 11/2017 | Frazier | B66D 1/22 |
| 2018/0118533 | A1 * | 5/2018 | Karambelas | B66D 1/48 |
| 2018/0201486 | A1 * | 7/2018 | Huang | B66D 1/14 |

* cited by examiner

*Primary Examiner* — Michael E Gallion
(74) *Attorney, Agent, or Firm* — W&K IP

(57) ABSTRACT

The present disclosure discloses a double-speed electric winch and an operating method of the winch. The winch comprises two groups of planetary gears with different transmission ratios in a gearbox. The two groups of planetary gears have corresponding outer ring gears. The gearbox has a rotatable handle which has a locking head inserted in the gearbox. As the handle rotates, the locking head engages with the outer ring gears in different manners to provide a first rotating speed mode, a second rotating speed mode, and a disengaged mode.

9 Claims, 5 Drawing Sheets

DOUBLE-SPEED ELECTRIC WINCH AND OPERATING METHOD THEREOF

TECHNICAL FIELD

The present disclosure relates to a winch and an operating method of the winch.

BACKGROUND OF THE PRESENT INVENTION

An electric winch is a device that can be used for traction, such as a winch included in a vehicle. The winch can be used for rescue in harsh environments. An existing electric winch is usually composed of a motor, a transmission shaft, a planetary gear reduction box, and a winding drum. The planetary gear reduction box is used to transmit power between the motor and the winding drum, so that a steel wire rope wound on the winding drum can produce a greater traction force and embodies the traction function. In addition to the traction function, the electric winch is often provided with a clutch mechanism in the planetary gear reduction box for cutting off the power transmission between the motor and the winding drum, thereby facilitating the winding and unwinding of the wire rope on the winding drum. Most of the existing electric winches are those having single-speed clutch control, but the single-speed winch has limited application scenarios and may be less suited for multi-speed traction tasks. Although some electric winches in the prior art include speed control functions, the speed regulation mechanism is mostly realized by speed regulating gears of different gear ratios. The installation for an existing winch may be complicated, and a large space may be required. Improvement is still needed for an existing electric winch.

SUMMARY OF PRESENT INVENTION

To overcome at least some of the above disadvantages including the complicated installation and inconvenient rotation speed adjustment, an objective of the present disclosure is to provide a double-speed electric winch and an operating method.

A double-speed electric winch of an embodiment comprises a motor, a winding drum, a transmission shaft, a gear component, and a hexagonal center wheel. The gear component comprises a gearbox. The gearbox comprises a first planetary gear assembly, a second planetary gear assembly and a third planetary gear assembly. An output end of the motor is connected to an end of the transmission shaft. The other end of the transmission shaft is connected to the hexagonal center wheel. The hexagonal center wheel is drivably connected to the first planetary gear assembly. The first planetary gear assembly, the second planetary gear assembly and the third planetary gear assembly are sequentially connected to form a deceleration transmission. The third planetary gear assembly is drivably connected to the winding drum. The second planetary gear assembly has two planetary gears of different transmission ratios. Two outer ring gears are rotatably arranged within the gearbox in correspondence to the two planetary gears. The two outer ring gears comprise a locking component which forms an annular groove.

In an embodiment, the gearbox comprises a rotatable handle having a locking head provided on an end of the handle inserted into the gear box. The locking head locks to a first one of the two outer ring gears corresponding to the two planetary gears when the handle is rotated to a first limiting end. The locking head locks to a second one of the two outer ring gears corresponding to the two planetary gears when the handle is rotated to a second limiting end. The locking head is positioned in the annular groove between the two outer ring gears when the handle is rotated to a middle position between the first and second limiting ends. The locking head is not in contact with the two outer ring gears when rotating with the two outer ring gears.

In an embodiment, the locking component comprises slots distributed uniformly along the outer circumferential surface of the outer ring gears. The locking head limits the rotation of the outer ring gears corresponding to the slots when the locking head is placed in the slots. The locking head is eccentrically disposed with respect to a rotation axis of the handle.

In an embodiment, the handle comprises a rotating shaft. The rotating shaft comprises a concave half groove. The gearbox comprises a shaft seat which is movably engaged with the rotating shaft. The shaft seat is laterally connected with a limiting screw. The limiting screw extends into the half groove of the rotating shaft to rotate the handle.

In an embodiment, each of the first limiting end, the second limiting end, and the middle position in the half groove of the rotating shaft has a station slot indicating that the limiting screw has slided into position. A resilient gasket is arranged between the handle and the shaft seat. The resilient gasket is used to lock the limiting screw to the station slot when the limiting screw slides to the station slot.

In an embodiment, the resilient gasket is a rubber gasket.

A method to operate the winch of an embodiment comprises the following steps: switching on the motor; driving the transmission shaft and the hexagonal center wheel by the motor; driving the first planetary gear assembly to rotate by the hexagonal center wheel; locking the locking head onto a first outer ring gear of the second planetary gear assembly when the handle is rotated to a first limiting end; and operating the winch at a first rotating speed mode, when the first planetary gear assembly transmits driving power to the third planetary gear assembly and the winding drum by a first planetary gear of the second planetary gear assembly corresponding to the first outer ring gear.

In an embodiment, the method further comprises locking the locking head onto a second outer ring gear of the second planetary gear assembly when the handle is rotated to a second limiting end; and operating the winch at a second rotating speed mode, when the first planetary gear assembly transmits driving power to the third planetary gear assembly and the winding drum by a second planetary gear of the second planetary gear assembly corresponding to the second outer ring gear.

In an embodiment, the method further comprises maintaining the locking head within the annular groove between the two outer ring gears when the handle is rotated to a middle position between the first and second limiting ends; and operating the winch at a disengaged mode, when neither of the first outer ring gear and the second outer ring gear is locked onto and the second planetary gear assembly is not transmitting the driving power.

The embodiment divides the second planetary gear into two groups of planetary gears having separated outer ring gears and different transmission ratios. The locking status of the two outer ring gears can be switched by rotating the handle. The transmission engagement of the two groups of planetary gears with the first and third planetary gear assemblies can also be switched as a result. Convenient speed adjustment and clutch mechanism are both achieved in a relatively smaller space and a more compact structure. The winch is suited for controlling a double-speed electric winch or improving upon an existing electric winch.

REFERENCE NUMBERS

1 motor 2 winding drum; 3 transmission shaft; 4 gearbox; 401 shaft seat; 5 hexagonal center wheel; 6 first planetary gear assembly; 7 second planetary gear assembly; 701 outer ring gear; 702 slot; 703 annular groove; 8 third planetary gear assembly; 9 handle; 901 rotating shaft; 902 half groove; 903 station slot; 904 locking head; 10 limiting screw; 11 rubber gasket.

DETAILED DESCRIPTION OF PREFERRED EMBODIMENTS

Embodiments of the present disclosure will be described below in greater details with reference taken to the accompanying drawings.

Figure 1:
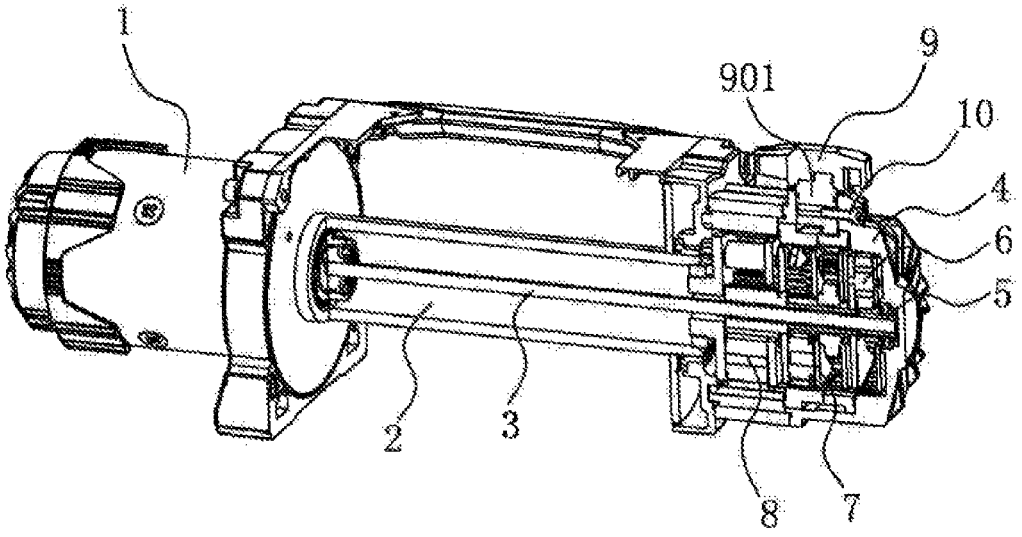
FIG. 1 is a cross-sectional view of an embodiment of the present disclosure.
Figure 2:
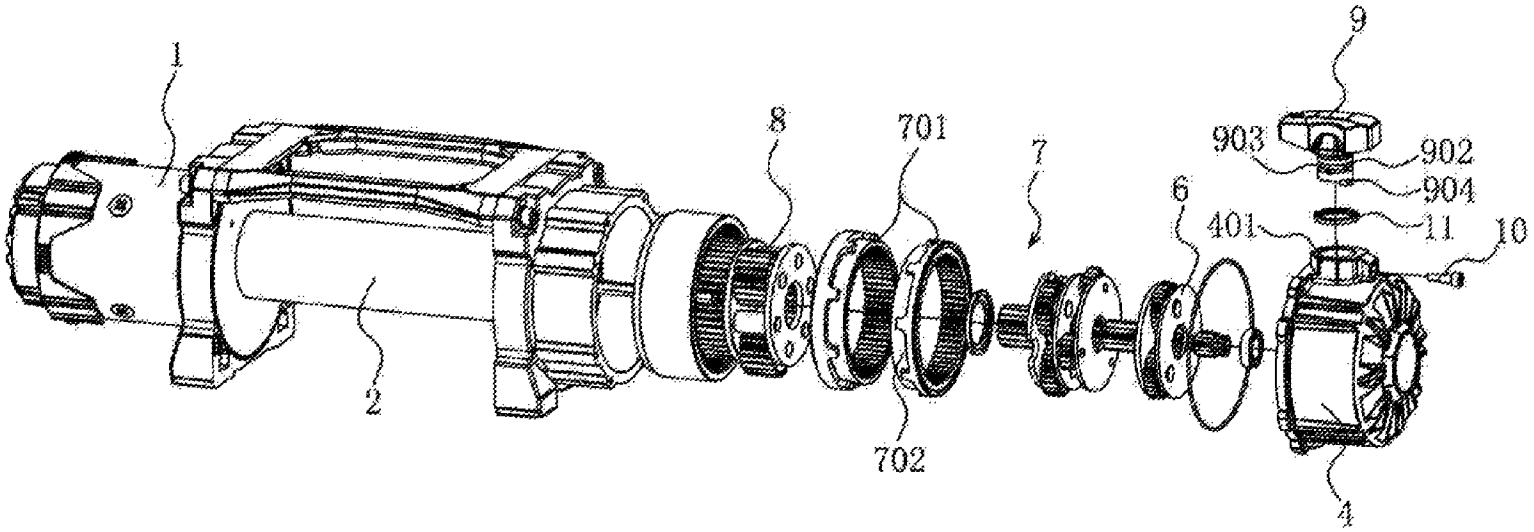
FIG. 2 is an explosive view of an embodiment of the present disclosure.
Figure 3:
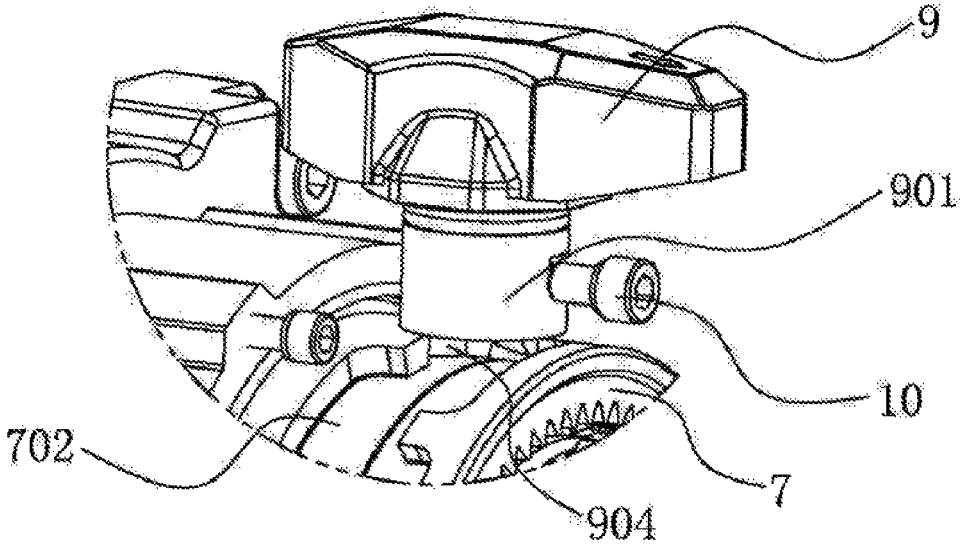
FIG. 3 is a structural schematic of an embodiment where a first rotating speed mode is selected by rotating the handle.
Figure 4:
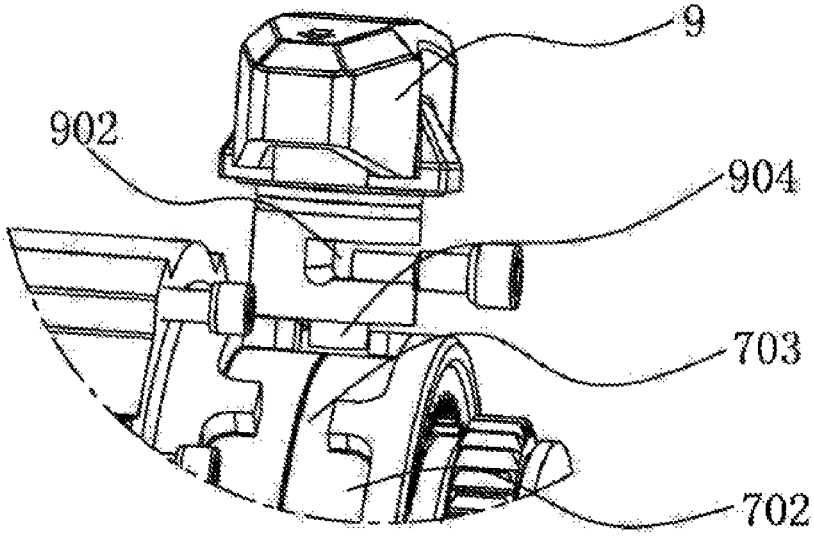
FIG. 4 is a structural schematic of an embodiment where a disengaged mode is selected by rotating the handle.
Figure 5:
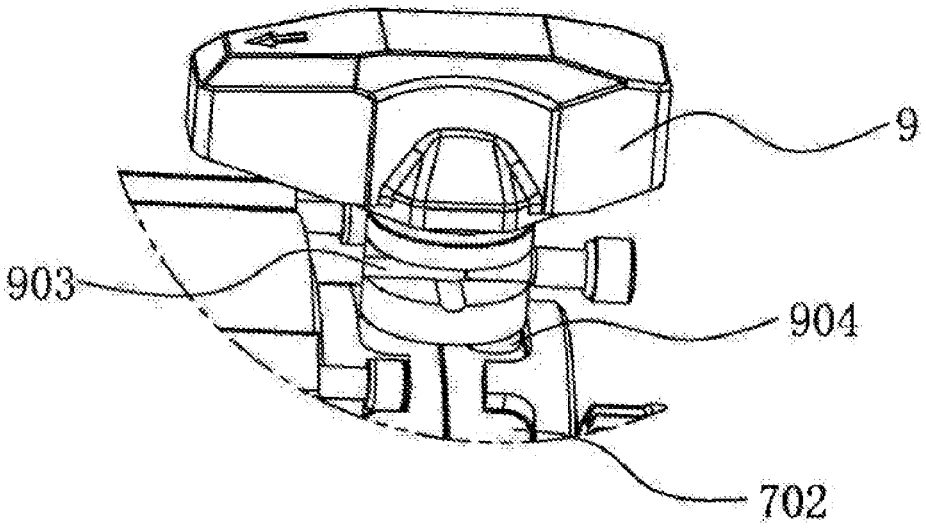
FIG. 5 is a structural schematic of an embodiment where a second rotating speed mode is selected by rotating the handle.

As shown in FIGS. 1-5, an exemplary double-speed electric winch comprises a motor 1, a winch bracket, a winding drum 2, a transmission shaft 3, a gear component, a hexagonal center wheel 5, and a handle 9. The gear component comprises a gearbox 4. The gearbox 4 comprises a first planetary gear assembly 6, a second planetary gear assembly 7 and a third planetary gear assembly 8. An output end of the motor 1 is connected to an end of the transmission shaft 3. The other end of the transmission shaft 3 is connected to the hexagonal center wheel 5. The hexagonal center wheel 5 is drivably connected to the first planetary gear assembly 6. The motor 1 is connected to the first planetary gear assembly 6 through the transmission shaft 3 and the hexagonal center wheel 5. The first planetary gear assembly 6, the second planetary gear assembly 7 and the third planetary gear assembly 8 are sequentially connected to form a deceleration transmission. The third planetary gear assembly 8 is drivably connected to the winding drum 2. The gearbox 4 comprises fixed ring gears that are matched to the planetary gears of the first planetary gear assembly 6 and the third planetary gear assembly 8. The second planetary gear assembly 7 has two planetary gears of different transmission ratios, and two separated outer ring gears 701 that correspond to the two planetary gears. The two outer ring gears 701 are rotatably disposed in the gearbox 4. Each of the two outer ring gears 701 comprises slots 702 distributed uniformly along the outer circumferential surface. The slots 702 of the two outer ring gears 701 form an annular groove 703, which can be used as a locking component. The handle 9 is disposed outside the gearbox 4. The handle 9 comprises a rotating shaft 901. The rotating shaft 901 comprises a concave half groove 902. The gearbox 4 comprises a shaft seat 401 which is movably engaged with the rotating shaft 901. The shaft seat 401 is laterally connected with a limiting screw 10. The limiting screw 10 extends into the half groove 902 of the rotating shaft 901 to enable rotation of the handle 9 relative to the gearbox 4. One end of rotating shaft 901 is inserted into the gearbox 4 and this particular end gearbox comprises a locking head 904 eccentrically disposed with respect to a rotation axis of the handle 9. When the handle 9 is rotated to a first limiting end, the locking head 904 would be only locked to the slots 702 of a first one of the two outer ring gears 701. When the handle 9 is rotated to a second limiting end, the locking head 904 would be only locked to the slots 702 of a second one of the two outer ring gears 701. When the handle 9 is rotated to a middle position between the first and second limiting ends, the locking head 904 would be positioned in the annular groove 703 between the two outer ring gears 701. The locking head 904 would not be in contact with the two outer ring gears 701 when the locking head 904 is rotating with the two outer ring gears 701.

In order to improve the accuracy of the rotation of the handle 9, each of the first limiting end, the second limiting end, and the middle position in the half groove 902 of the rotating shaft 901 has a station slot 903 indicating that the limiting screw 10 has slided into position. A resilient gasket is arranged between the handle 9 and the shaft seat 401. The resilient gasket is used to lock the limiting screw 10 to the station slot 903 when the limiting screw 10 slides to the position of the station slot 903. The resilient gasket can be a rubber gasket 11.

A workflow of the double-speed electric winch is as follows: The motor 1 is switched on to drive the transmission shaft 3 and the hexagonal center wheel 5 to rotate. The first planetary gear assembly 6 would be driven to rotate by the hexagonal center wheel 5. When the handle 9 is rotated to a first limiting end, the locking head 904 of the handle 9 would be only locked onto the slots 702 of a first outer ring gear 701 of the second planetary gear assembly 7. At this time, the first planetary gear assembly 6 transmits driving power to the third planetary gear assembly 8 and the winding drum 2 by a first planetary gear of the second planetary gear assembly 7, which corresponds to the first outer ring gear 701. A first rotating speed mode, or a low speed mode is enabled in this situation. When the handle 9 is rotated to a second limiting end, the locking head 904 of the handle 9 is only locked onto the slots 702 of a second outer ring gear 701 of the second planetary gear assembly 7. At this time, the first planetary gear assembly 6 transmits driving power to the third planetary gear assembly 8 and the winding drum 2 by a second planetary gear of the second planetary gear assembly 7, which corresponds to the second outer ring gear 701. A second rotating speed mode, or a high speed mode is enabled in this situation. When the handle 9 is rotated to a middle position between the first and second limiting ends, the locking head 904 would be positioned within the annular groove 703 between the two outer ring gears 701.

In this situation, neither of the two outer ring gears is locked onto the locking head 904, and the second planetary gear assembly 7 is not transmitting any driving power. Therefore, a disengaged mode, or an idle mode in which the winch is not operating is enabled.

The above description is provided for a thorough understanding of the technical solution of the present disclosure, but not to limit the scope of the present disclosure. The skilled in the art would anticipate obvious modifications by combining common knowledge with the embodiments disclosed herein. For example, the slots of the outer ring gears can be substituted by teeth to achieve a similar locking function. The variations and modifications are also included in the scope and principle of the present disclosure.

I claim:

1. A double-speed electric winch, comprising:

a motor, a winding drum, a transmission shaft, a gear component, and a hexagonal center wheel, wherein the gear component comprises a gearbox;

the gearbox comprises a first planetary gear assembly, a second planetary gear assembly and a third planetary gear assembly;

an output end of the motor is connected to an end of the transmission shaft, the other end of the transmission shaft is connected to the hexagonal center wheel;

the hexagonal center wheel is drivably connected to the first planetary gear assembly;

the first planetary gear assembly, the second planetary gear assembly and the third planetary gear assembly are sequentially connected to form a deceleration transmission;

the third planetary gear assembly is drivably connected to the winding drum;

the second planetary gear assembly has two planetary gears of different transmission ratios;

two outer ring gears are rotatably arranged within the gearbox in correspondence to the two planetary gears; and the two outer ring gears comprise a locking component which forms an annular groove.

2. The winch of claim 1, wherein the gearbox comprises a rotatable handle having a locking head provided on an end of the handle inserted into the gear box;

the locking head locks to a first one of the two outer ring gears corresponding to the two planetary gears when the handle is rotated to a first limiting end;

the locking head locks to a second one of the two outer ring gears corresponding to the two planetary gears when the handle is rotated to a second limiting end;

the locking head is positioned in the annular groove between the two outer ring gears when the handle is rotated to a middle position between the first and second limiting ends; and the locking head is not in contact with the two outer ring gears when rotating with the two outer ring gears.

3. The winch of claim 2, wherein the locking component comprises slots distributed uniformly along the outer circumferential surface of the outer ring gears;

the locking head limits the rotation of the outer ring gears corresponding to the slots when the locking head is placed in the slots; and the locking head is eccentrically disposed with respect to a rotation axis of the handle.

4. The winch of claim 3, wherein the handle comprises a rotating shaft;

the rotating shaft comprises a concave half groove;

the gearbox comprises a shaft seat which is movably engaged with the rotating shaft;

the shaft seat is laterally connected with a limiting screw; and the limiting screw extends into the half groove of the rotating shaft to rotate the handle.

5. The winch of claim 4, wherein each of the first limiting end, the second limiting end, and the middle position in the half groove of the rotating shaft has a station slot indicating that the limiting screw has slided into position;

a resilient gasket is arranged between the handle and the shaft seat; and the resilient gasket is used to lock the limiting screw to the station slot when the limiting screw slides to the station slot.

6. The winch of claim 5, wherein the resilient gasket is a rubber gasket.

7. A method to operate the winch of claim 6, comprising the following steps:

switching on the motor;

driving the transmission shaft and the hexagonal center wheel by the motor;

driving the first planetary gear assembly to rotate by the hexagonal center wheel;

locking the locking head onto a first outer ring gear of the second planetary gear assembly when the handle is rotated to a first limiting end; and operating the winch at a first rotating speed mode, when the first planetary gear assembly transmits driving power to the third planetary gear assembly and the winding drum by a first planetary gear of the second planetary gear assembly corresponding to the first outer ring gear.

8. The method of claim 7, further comprising:

locking the locking head onto a second outer ring gear of the second planetary gear assembly when the handle is rotated to a second limiting end; and operating the winch at a second rotating speed mode, when the first planetary gear assembly transmits driving power to the third planetary gear assembly and the winding drum by a second planetary gear of the second planetary gear assembly corresponding to the second outer ring gear.

9. The method of claim 8, further comprising:

maintaining the locking head within the annular groove between the two outer ring gears when the handle is rotated to a middle position between the first and second limiting ends; and operating the winch at a disengaged mode, when neither of the first outer ring gear and the second outer ring gear is locked onto and the second planetary gear assembly is not transmitting the driving power.

* * * * *